United States Patent [19]

Berry

[11] 4,399,657

[45] Aug. 23, 1983

[54] STEAM GENERATION SYSTEM

[76] Inventor: Clyde F. Berry, R.F.D. 7, Box 169 C, Manchester, N.H. 03104

[21] Appl. No.: 368,403

[22] Filed: Apr. 14, 1982

[51] Int. Cl.[3] ..... F01K 11/00

[52] U.S. Cl. ..... 60/664; 60/669; 60/670; 60/688; 122/13 A; 219/271; 219/272; 219/273; 290/2; 290/4 C; 415/175

[58] Field of Search ..... 60/643, 645, 648, 654, 60/664, 669, 670, 688, 691, 694; 122/4 A, 13 A, 414, 458; 219/271, 272, 273, 275; 290/2, 4 C; 415/116, 175, 176

[56] References Cited

U.S. PATENT DOCUMENTS

| | | | |
|---|---|---|---|
| 258,932 | 6/1882 | Litchfield et al. | 60/654 |
| 423,421 | 3/1890 | Farrall | 219/275 X |
| 1,034,952 | 8/1912 | Ball | 122/13 A |
| 1,258,642 | 3/1918 | Bergeron | 219/272 X |
| 2,467,818 | 4/1949 | Elston | 415/176 X |
| 3,487,423 | 12/1969 | White | 60/669 X |
| 3,977,198 | 8/1976 | Berry | 60/676 |

FOREIGN PATENT DOCUMENTS 2813614 10/1979 Fed. Rep. of Germany ..... 122/4 A

*Primary Examiner*—Allen M. Ostrager
*Assistant Examiner*—Stephen F. Husar
*Attorney, Agent, or Firm*—C. Yardley Chittick

[57] ABSTRACT

Steam generation means in a closed system having a pressured steam boiler positioned within a closed heated feed water chamber. The steam generated in the boiler is used to drive a turbine and an associated electrical generator whose output augments the outside primary source of electrical power which is fed to one or more electrical resistance units located in the boiler. The exhaust steam from the turbine at reduced pressure is used to supply heat in any closed steam consuming device such as a space heating system. The condensate is returned to the feed water chamber where it is held in preheated condition ready to be pumped into the boiler to maintain the boiler water level. The efficiency of the system is substantially increased by having means for raising the temperature of the turbine and turbine housing thereby to lessen the temperature drop of the steam entering and leaving the turbine.

12 Claims, 5 Drawing Figures

STEAM GENERATION SYSTEM

FIELD OF THE INVENTION

The invention relates to a method and means for steam generation and the utilization thereof. Steam is ordinarily used as means for heating or for driving some prime mover such as a steam turbine or reciprocating engine.

In the case of steam heating, the system is usually of the closed circuit type in which the condensate is returned to the boiler for re-use.

In the case of steam driven engines, the exhaust steam leaving the prime mover may be discharged to the atmosphere or, in a closed system, after giving up its heat to the steam utilization means, the condensate may be returned to the boiler. See for example the patent to Berry U.S. Pat. No. 3,977,198.

In the production of steam for any of the above uses, the heat source is customarily coal, oil, gas or other combustible fuel. In the present invention the heat source is provided preferably by electric power, part of which is generated in a self-contained steam electric system.

SUMMARY OF THE INVENTION

The present invention contemplates the use of an efficient one-boiler system in which a pressurized boiler is located in proximity with a somewhat larger closed feed water chamber. The source of heat for the boiler is one or more electric heating elements, the power for which is supplied primarily by an outside source of current and augmented by current from a generator driven continuously by a steam operated turbine when the system is in operation.

Heat is preferably supplied to the water in the feed water chamber by radiation from the boiler. The temperature of the feed water is maintained preferably at 212° F. but may be slightly less. The water vapor emanating therefrom is fed continuously to the space between the turbine housing and a surrounding outer housing whereby the turbine housing is always in a relatively high heated condition to improve the efficiency of the turbine.

Alternatively the water in the feed water chamber could be heated by an electric heating element functioning under suitable temperature controls.

If preferred, the space between the two turbine housings could be heated by steam piped thereto from the boiler.

The exhaust steam from the turbine that drives the generator may be used for space heating or actuation of any other steam utilization device operating in a closed system whereby the condenser will be returned to the feed water chamber.

From the foregoing it will be understood that an important object of the invention it to improve the efficiency of means for producing steam to be used in a closed steam utilization system.

These and other objects will become more apparent as the description proceeds with the aid of the accompanying drawings in which FIG. 1 is a vertical sectional view, and FIG. 2 is an enlarged vertical section taken on the line 2—2 of FIG. 1 modified slightly to show minor alternative constructions.

DESCRIPTION OF A PREFERRED EMBODIMENT

Figure 1:
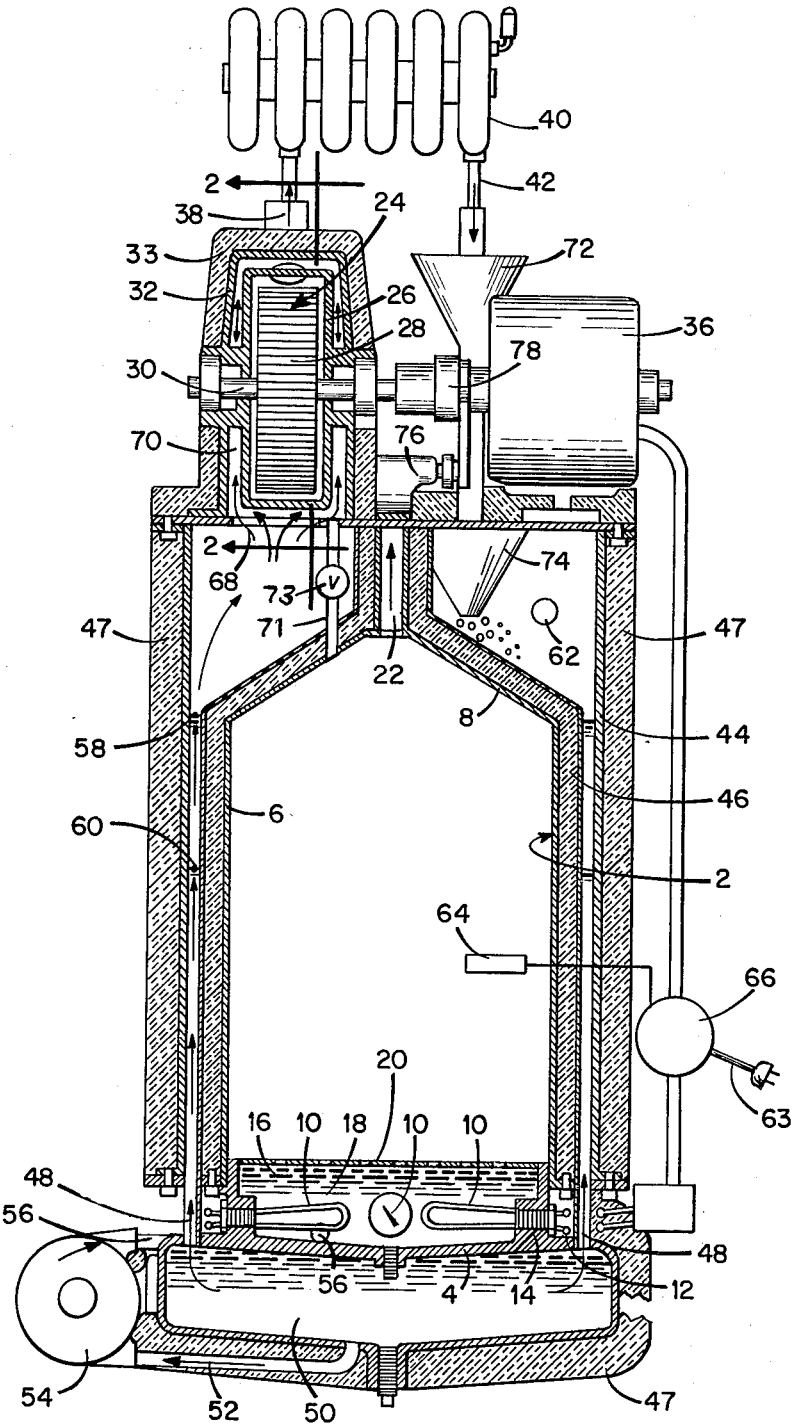

Referring to FIG. 1, there is shown at 2 a pressurized boiler having a bottom 4, a cylindrical vertical wall 6 and a conical top 8.

Adjacent the bottom 4 are a plurality of electrical heating elements 10, all of known construction with terminals 12 extending to the outside of the thickened bottom wall portion 14.

Boiler water having high and low levels at 16 and 18 adequately covers the heating elements but being of limited quantity is quickly converted to steam. Additional feed water is automatically supplied as needed by well known means. Preferably a perforated baffle 20 is used to keep the boiling water and wet steam from mixing with the drier steam above.

Figure 2:
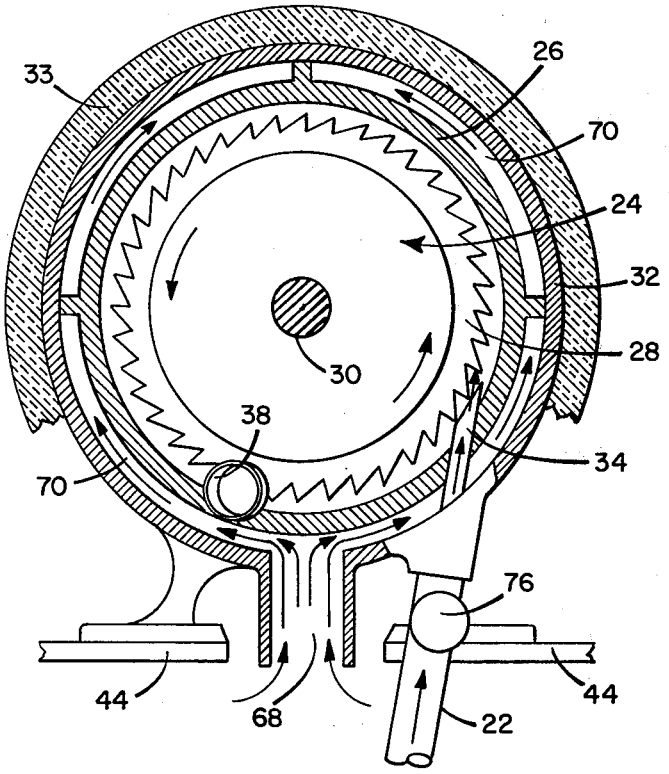

The upper end of boiler 2 discharges the steam through pipe 22, which as suggested in FIG. 2 leads to the steam turbine 24. The turbine comprises a housing 26, a rotor 28 carried by a shaft 30 which is supported by suitable bearings (not shown).

The housing 26 is encased by an outer housing 32 with the space therebetween adapted to receive either hot water vapor from the feed water chamber or live steam from the boiler by means to be explained shortly. Outer housing 32 is additionally thoroughly insulated as indicated at 33.

High velocity steam being discharged from nozzle 34 causes rotation of rotor 28 and shaft 30. Shaft 30 drives electric generator 36.

Exhaust steam from the turbine passes through exhaust pipe 38 to any suitable closed system steam-using device such as the radiator 40 from which condensate is returned by pipe 42 to the feed water chamber.

The feed water chamber that contains the pressured boiler is indicated at 44. It fits relatively closely around boiler 2. Boiler 2 is insulated over its entire outer surface by insulation 46 to control the rate of heat radiation to the water in the feed water chamber. Feed water chamber 44 is completely externally insulated as at 47.

Pipes 48 lead down from the bottom of feed water chamber 44 to a feed water supply tank 50 from which water may be supplied to boiler 2 by pipe 52, pump 54 and pipe 56.

The water level in feed water chamber 44 is preferably maintained between high and low levels 58 and 60. Any additional water needed in feed water chamber 44 is supplied by fill pipe 62.

The primary source of current for heating elements 10 is an outside line 63 which is switched on and off by a pressure operated control 64 which activates a solenoid controlled switch 66. When the system is in operation, current from generator 36 is added to the outside supply when the latter is on. When the outside surface is off, the current from generator 36 is enough to greatly diminish the rate of all of the steam pressure.

At the top of feed water chamber 44 is a passage 68 through which hot water vapor, coming from the hot water in feed water chamber 44, flows continuously into the space 70 between the inner and outer housings 26 and 32 of turbine 24. Any condensate will drain back into feed water chamber 44.

An alternate method of heating the turbine and surrounding housing can be accomplished by running a pipe 71 from boiler 2 to space 70 with the flow of steam controlled by a manually operated valve 73.

Condensers 72 and 74 if desired may be included in the return feed line 42.

When the system is in operation, it is desirable that the generator 36 run at a substantially constant speed. Hence controls 76 and 78 may be included to vary the steam flow to the turbine so that the proper speed is maintained despite varying steam pressure in boiler 2.

From the foregoing explanation, it will be seen that the exhaust steam from the turbine 24 used in a steam consuming device such as a space heater or radiator in a closed system can be generated very economically. The initial start up is accomplished by using an outside source of current 63 to activate the heating elements 10. When steam is generated, the turbine generator set goes into operation and the exhaust turbine steam is fed to the radiators 40 or other steam consuming device with the condensate returned to the feed water chamber. As the boiler pressure rises, the pressure control 64 operates switch 66 to shut off the outside current but the generator continues to feed heating elements 10. The generator supplies enough current to maintain the steam pressure at a slowly diminishing rate. When the pressure reaches a predetermined low point, control 64 functions again to turn on the outside current augmented by the continuing operation of generator 36.

It will be understood that the specific electrical arrangements may be varied while still within the scope of the appended claims. As shown, current is supplied to each heating element 10 continuously by generator 36 and intermittently by the outside current source 63. Alternatively, one of the heating elements could be connected exclusively to the generator 36 and another exclusively to the outside source.

The number of heating elements is a matter of choice determined by the heat requirements of the system and the capacity of the elements. Likewise the volume of water contained between the cylindrical walls of the inner boiler and outer chamber is a matter of judgment so as to produce continuous hot water vapor at a temperature of about 212° F.

If the system is utilized with conventional steam radiators in a home, for example, the operating cycle would be substantially as follows. With the system shut down, a conventional room thermostat would call for heat, closing a switch in the outside current source line 63. There being no pressure in boiler 2, switch 66 would be closed so current would immediately be supplied to elements 10. In due course, steam would be generated in boiler 2 and when the pressure became high enough to operate the turbine, the valve in governor 76 would open to commence operation of turbine 24 and generator 36.

Generator 36 would feed additional current to element 10 to raise the element temperature or to decrease the outside current supply. As soon as the steam pressure reached the predetermined high degree, control 64 acts to cut off the outside current source 63 but since the turbine remains in operation, the element 10 continues to be heated by current from generator 36. This current is not sufficient to maintain high steam pressure but it creates enough heat in element 10 to cause a much slower decline in pressure than that which would occur in its absence.

In the meanwhile, exhaust steam is flowing from the turbine to the building radiation to heat the building as desired. When the steam pressure drops to a predetermined low, (with the turbine still in continuous operation) the outside current source comes on again to go through another build up of pressure as previously described.

In due time, the heat requirement in the building will be satisfied and the thermostat will cut off the outside source, the steam pressure will drop, the control 76 will function to cut off the steam to the turbine and operation will cease.

While all of the foregoing was taking place, the efficiency of the system was being increased by the continuous introduction of hot water vapor or very low pressure steam generated in feed water chamber 44 or of live steam from boiler 2 flowing through pipe 71 into the space 70 between the outer and inner turbine housings 32 and 26.

This improved efficiency is obtained by utilizing the normally radiated heat from the boiler to heat the limited water in the feed water chamber to substantially the boiling point. The result is that the free flow of hot water vapor or live boiler steam into the space 70 will continuously hold the temperature of the inner turbine housing well above the figure that would prevail were the housing heated solely by the high pressure steam driving the turbine rotor. Hence the temperature drop in the exhaust steam is substantially reduced and the heat delivered to the radiators is increased.

In some installations, the pipe 42 returning the condensate to feed water chamber 44 is of such length that the condensate is excessively cooled. Therefore it may be desirable to include means such as shown in FIGS. 3, 4 and 5 for heating the returning condensate before it reaches chamber 44 thereby to assist in maintaining the feed water at 212° F. or close thereto.

Figure 3:
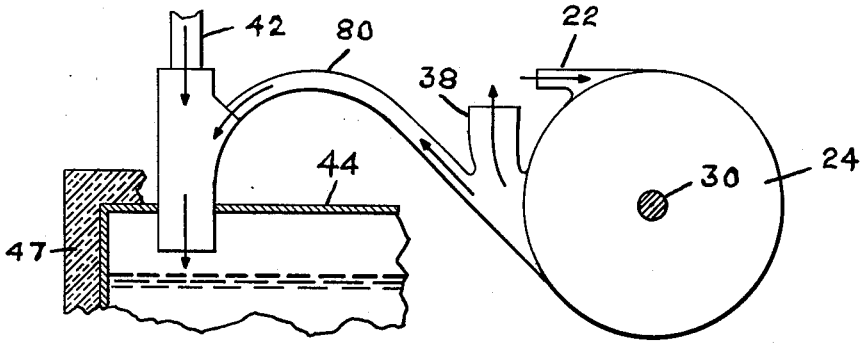
FIG. 3 shows a modification in which the returning condensate is heated by mixing it with a small amount of the exhaust steam.

In FIG. 3, a limited amount of exhaust steam is bled off from exhaust pipe 38 through pipe 80 to enter pipe 42 to heat the returning condensate as it enters chamber 44.

Figure 4:
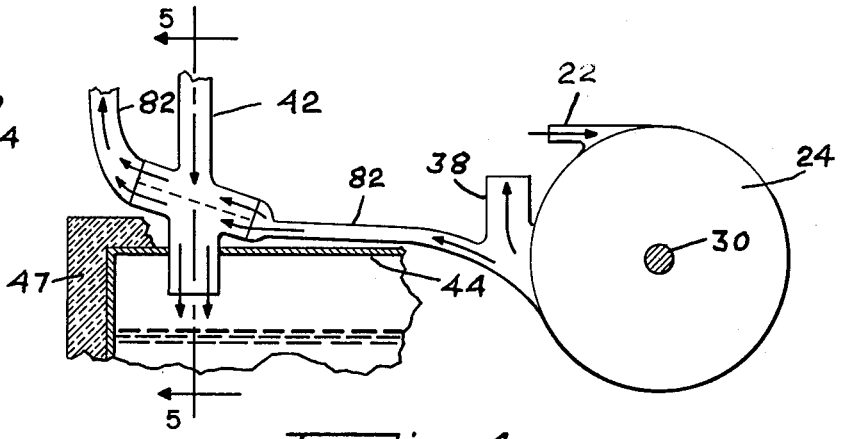
FIG. 4 shows another modification for heating the returning condensate in which the condensate is passed over tubes through which exhaust steam is flowing.

In FIG. 4, some of the exhaust steam is led away from exhaust pipe 38 through pipe 82 to intersect return 42 in such manner that the condensate passes over the hot pipe 82 to be heated just before reaching chamber 44.

Figure 5:
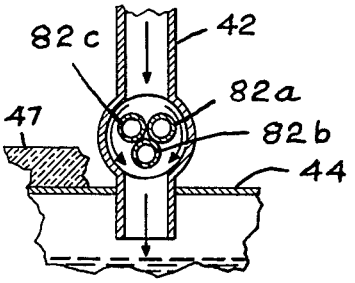
FIG. 5 is an enlarged vertical section taken on the line 5—5 of FIG. 4.

As shown in FIG. 5 which is a vertical section on line 5—5 of FIG. 4, pipe 82 is expanded into a plurality of pipes **82*a*, 82*b* and 82*c* as they pass through pipe 42 to present a greater hot surface area to the condensate flowing down pipe 42 into chamber 44**.

Pipe 82 may lead back into exhaust pipe 38 or go directly to another radiator 40, for example.

In the claims, the term "hot water vapor" is to be understood as meaning both the low pressure vapors generated in the feed water chamber or the higher pressure steam from the boiler.

The above disclosure will suggest to others skilled in the art modifications which are within the scope of the invention as defined by the appended claims.

I claim:

1. In combination, a steam generating unit comprising a steam boiler and a feed water chamber within which said boiler is positioned, a steam turbine comprising a turbine housing and a rotor, an electrical generator driven by said rotor, electrical heating elements located in the water of said boiler arranged to be activated by an outside source of current and by current from said generator, the water in said feed water chamber being heated by radiation from said boiler, said turbine housing being located within and in spaced relation from an outerhousing, means for delivering steam from said boiler to said steam turbine, and means for delivering hot water vapor directly from said steam generating unit to the space between said outer housing and said turbine housing.

2. The combination set forth in claim 1, the said feed water chamber being the source of said hot water vapor.

3. The combination set forth in claim 1, the said boiler being the source of said hot water vapor.

4. The combination set forth in claim 1, and piping to carry exhaust steam from said steam turbine to steam utilization means and piping to return condensate to said feed water chamber.

5. The combination set forth in claim 4, and means utilizing some of the said exhaust steam for raising the temperature of said condensate as it is returning to said chamber.

6. A closed steam utilization system comprising a steam generating unit, said unit comprising a boiler located within a larger chamber which functions as a feed water heater, electrically actuated heating elements in heat transfer engagement with the water in said boiler, an external electrical power supply for said heating elements sufficient to produce steam in said boiler, a turbine comprising a housing and rotor driven by steam from said boiler, an electric generator driven by said turbine, means for delivering the electrical output of said generator to said heating elements, means for utilizing the exhaust steam from said turbine and means for returning the condensate of said exhaust steam to said feed water chamber, the water in said feed water chamber being heated by radiation from said boiler, the housing of said turbine positioned in spaced relation within a steam tight outer housing, the interior of said outer housing connected directly to said steam generating unit whereby hot water vapor may flow from said unit into the space between said turbine housing and said outer housing to maintain the turbine and turbine housing at a temperature higher than it would be in the absence of said outer housing.

7. The combination set forth in claim 6, said source of hot water vapor being said feed water chamber.

8. The combination set forth in claim 6, said source of hot water vapor being said boiler.

9. The combination set forth in claim 6, and means controlled by the pressure in said boiler for turning the external power supply off when a predetermined high pressure is reached and on, when a predetermined low pressure is reached.

10. The combination set forth in claim 6, and insulation surrounding said boiler to limit the rate of heat transfer to the water in said feed water chamber.

11. The combination set forth in claim 6, said boiler and said feed water chamber being cylindrical and arranged coaxially to provide therebetween a vertical cylindrical space for a relatively small volume of water thereby to minimize the heat transfer from said boiler to produce the hot water vapor in said feedwater chamber.

12. The combination set forth in claim 6, and means utilizing some of the said exhaust steam for raising the temperature of said condensate as it is returning to said chamber.

* * * * *